US005105229A

United States Patent [19]

Ozaki

[11] Patent Number: 5,105,229

[45] Date of Patent: Apr. 14, 1992

[54] IMAGE RECORDING APPARATUS

[75] Inventor: Hiroshi Ozaki, Tokyo, Japan

[73] Assignee: Canon Kabushiki Kaisha, Tokyo, Japan

[21] Appl. No.: 549,078

[22] Filed: Jul. 6, 1990

[30] Foreign Application Priority Data

Jul. 7, 1989 [JP] Japan ..... 1-174069

[51] Int. Cl.[5] ..... G03G 21/00

[52] U.S. Cl. ..... 355/313; 271/9; 271/263; 355/206

[58] Field of Search ..... 271/9, 259, 263; 355/206, 207, 208, 311, 313, 314, 317

[56] References Cited

U.S. PATENT DOCUMENTS 4,515,465 5/1985 Miyoshi et al. ..... 355/206 X
4,521,102 6/1985 Motomura et al. ..... 355/206 X
4,627,711 12/1986 Schron ..... 355/206
4,763,160 8/1988 Honjo ..... 271/259 X
4,926,358 5/1990 Tani et al. ..... 355/311 X

*Primary Examiner*—A. T. Grimley
*Assistant Examiner*—Patrick Stanzione
*Attorney, Agent, or Firm*—Fitzpatrick, Cella, Harper & Scinto

[57] ABSTRACT

An image recording apparatus includes a sheet feeding unit for feeding a sheet to a recording position, recording unit for recording an image on the sheet fed by the sheet feeding unit, and jam detection unit for detecting a jamming in the apparatus. Sheet holding unit is provided for holding a sheet fed by the sheet feeding unit in accordance with a detection signal from the jam detection unit to reuse the sheet, thereby using a recording sheet efficiently even after a jam has occurred.

14 Claims, 10 Drawing Sheets

IMAGE RECORDING APPARATUS

BACKGROUND OF THE INVENTION

1. Field of the Invention

This invention relates to an image recording apparatus, and more specifically to an image recording apparatus which can use a recording sheet efficiently.

2. Description of the Related Art

Known image recording apparatuses, such as a copier, are used in combination with a recirculating document feeder (hereinafter referred to as "RDF"). In such a known image recording apparatus, originals in a stacking tray are separated one by one from the bottom of an original bundle, and a separated original is fed to an exposure position for exposing. After the completion of an exposure operation, the separated original is returned to the tray at the top of the original bundle.

Referring to FIG. 6A through 6C, a general sheet feed sequence system will be described in detail.

In FIG. 6A, an original S3 from the bottom of an original bundle S set in a RDF, such as three sheets of originals, is transported to an original platen 101. Then, a recording material P (hereinafter referred as "copying sheet") is conducted to a registration roller 159 by a feed roller 207 at a time when the original S3 arrives at a predetermined position as shown in FIG. 6B. When the copying sheet P arrives at the registration roller 159, a scanning operation of the original S3 by a illumination lamp 103 is started as shown in FIG. 6C. The registration roller 159 starts to feed the copying sheet toward photosensitive drum 131 at a time when the illumination lamp 103 passes through an image tip sensor 117, so as to record an image on the copying sheet P.

Thus, in a general sheet feed sequence system, the steps of exchanging originals, stoping the new original on the original platen, feeding a copying sheet from a cassette, waiting for the copying sheet to arrive at the registration roller, and starting a scanning operation, are all performed sequentially. No step starts until the previous step is complete.

In the interests of improving copying speed, a previously-fed sheet sequence system has been proposed.

In the previously-fed sheet sequence system, the steps of exchanging originals and stoping the new original on the original platen are performed at the same time as the steps of feeding a copying sheet from a cassette and waiting for the copying sheet to arrive at the registration roller. After all of these steps are completed, the scanning operation is started.

Such a sequence is shown in FIGS. 7A through 7C. In FIG. 7A, the scanning operation of the original S3 by the illumination lamp 103 is started. The registration roller 159 starts to feed the copying sheet to photosensitive drum 131 at a time when the illumination lamp 103 passes through the image tip sensor 117, so as to record an image on the copying sheet P.

In FIG. 7B, the illumination lamp 103 has returned to its initial position upon completion of the scanning operation. The next copying sheet P then starts to be fed by the feed roller 207 at the same time as the next original S2 starts to be transported to the original platen 101 and the transport of the original S3 is started.

The copying sheet P is set to the registration roller 159 before the original S2 is set on the original platen 101 as shown in FIG. 7C. The scanning operation is started at the same time as the original S2 is set on the original platen 101.

According to the previously-fed sheet sequence system, the copying sheet can be fed from a cassette to the registration roller 159 during the setting of an original on the original platen 101. Accordingly, the copying speed is improved as compared with the general sheet feed sequence system.

However, in the above described known image recording apparatus, when an original jamming occurs in the RDF during an exchange of originals, the copying sheet that corresponds to the jammed original has already been fed. Since the copying sheet cannot be returned to the cassette, the copying sheet cannot be used after the jam is cleared and is unavoidably discharged out of the apparatus as a plain sheet without being used.

Accordingly, the known image recording apparatus suffers from a problem in that one copying sheet is consumed whenever an original jamming occurs.

The known image recording apparatus also suffers from a problem in that the count of copied sheets is erroneously increased whenever the unused sheet is discharged.

SUMMARY OF THE INVENTION

Accordingly, an object of the present invention is to provide an image recording apparatus that can overcome the problems described above.

Another object of the present invention is to provide an image recording apparatus that can record an image at high speed.

Still another object of the present invention is to provide an image recording apparatus that can prevent an unnecessary consumption of a sheet.

It is still another object of the present invention to provide an image recording apparatus that performs reasonable operation without being affected by a malfunction.

Still another object of the present invention is to provide an image recording apparatus that can prevent an unnecessary charge to an operator.

These objects are acheived through the provision of an image recording apparatus comprising sheet feeding means for feeding a sheet to a recording position, recording means for recording an image on the sheet fed by said sheet feeding means, jam detection means for detecting a jamming in the apparatus, and sheet holding means for holding a sheet fed by said sheet feeding means in accordance with a detection signal from said jam detection means to reuse the sheet.

Other objects, features and advantages of the invention will become apparent from the following detailed description of the preferred embodiments of the present invention and the accompanying drawings.

DETAILED DESCRIPTION OF THE PREFERRED EMBODIMENTS

Preferred embodiments of the present invention will be described in detail herein with reference to the accompanying drawings.

Figure 1:
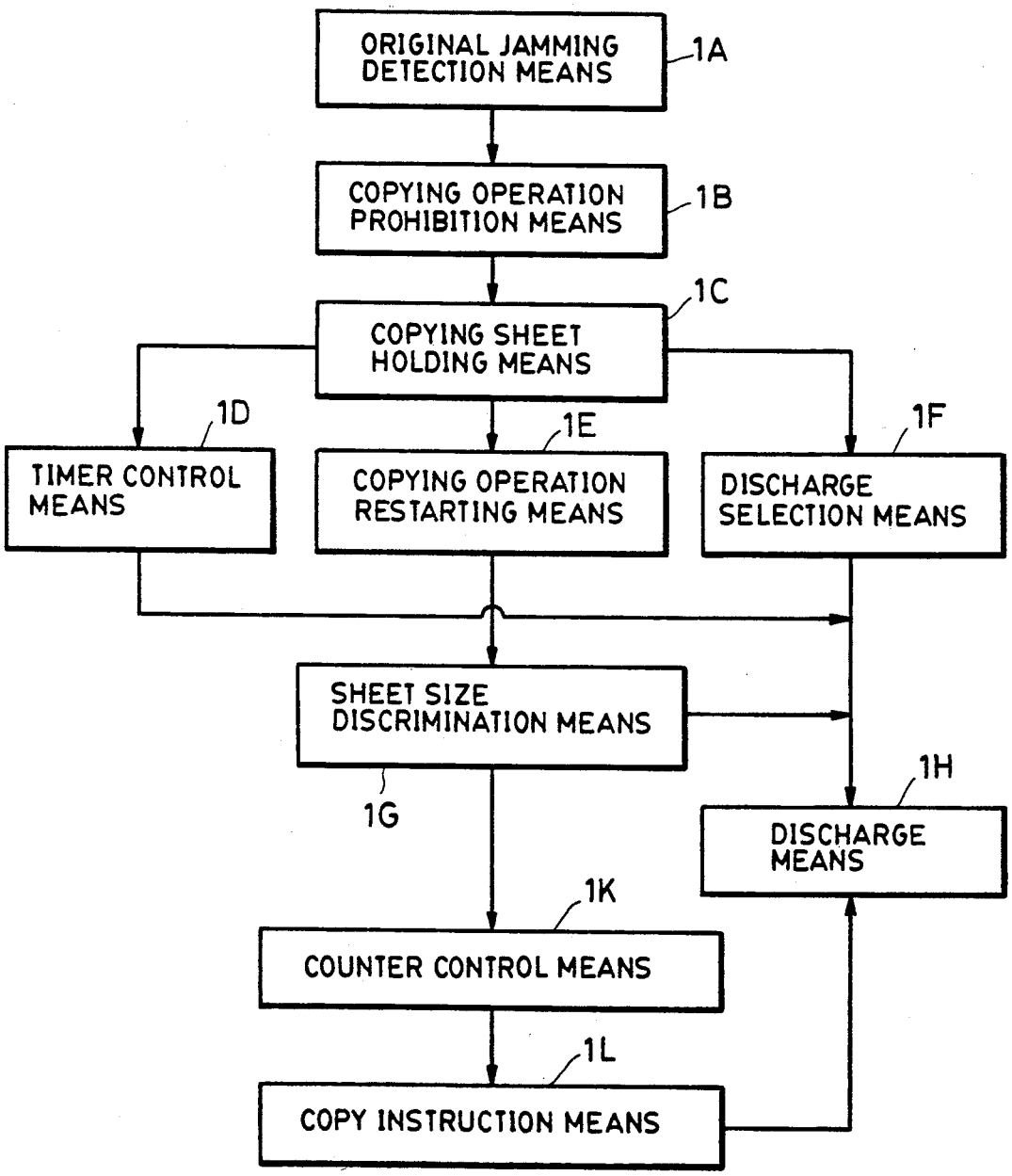
FIG. 1 is a block diagram showing the signal flow within an image recording apparatus according to the present invention.

FIG. 1 is a block diagram showing an arrangement of an image recording apparatus according to the present invention. The image recording apparatus in FIG. 1 includes an original jamming detection means 1A for detecting an original jamming in a recycle document feeder, a copying operation prohibition means 1B for interrupting a copying operation in accordance with a detection signal from the original jamming detection means 1A, and a copying sheet holding means 1C for holding a copying sheet to cause the copying sheet to be reused.

The image recording apparatus also includes a timer control means 1D, a copying operation restarting means 1E, a discharge selection means 1F, and a sheet size discrimination means 1G for discriminating coincidence between a designated sheet size and a previously fed sheet size. The image recording apparatus further includes a discharge means 1H for discharging a copying sheet, counter control means 1K for controlling the total number of copied sheets, and a copying instruction means 1L.

Figure 2:
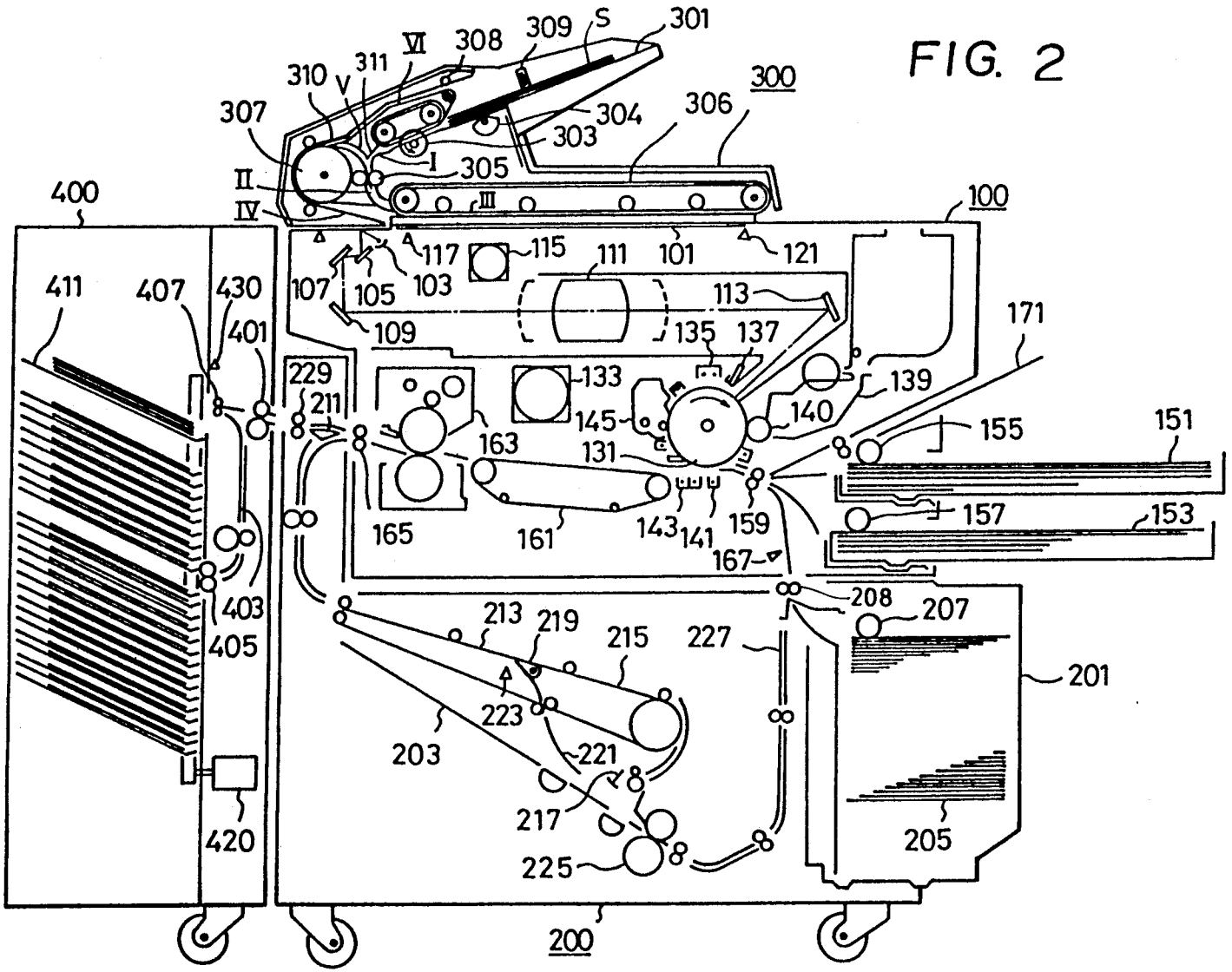
FIG. 2 is a schematic diagram showing an example of a copying apparatus to which this invention is applied.

FIG. 2 shows an embodiment of a copying apparatus to which this invention is applied.

The copying apparatus shown in FIG. 2 includes a copying apparatus main body 100, a pedestal 200 capable of turning over a recording medium (copying sheet) for allowing both front and back sides thereof to be copied (duplex copying) and a multi-recording function to allow a same recording medium (P) to be copied plural times, a recirculating document feeder 300 for performing automatic feeding of documents, and a sorter 400 for sorting recorded sheets into a plurality of bins. The main body 100 can be used with any desired combination of the units 200 to 400.

A. MAIN BODY 100

The main body 100 includes a platen glass 101 on which an original is placed, an illumination lamp (exposure lamp) 103 for illuminating an original, scan reflection mirrors 105, 107 and 109 for changing the optical path of a light reflected from the original, lens 111 having focus and variable magnification functions, a fourth scan reflection mirror 113 for changing the optical path, and a motor 115 for driving the optical system. The main body 100 also includes sensors 117, 121, a photosensitive drum 131, a main motor 133 for driving the photosensitive drum 131, a high voltage unit 135, a blank exposure unit 137, a developing unit 139, and a developing roller 140.

The main body 100 further includes a transfer charger 141, a separation charger 143, a cleaning unit 145, an upper cassette 151, a lower cassette 153, a manual sheet feed inlet 171, sheet feed rollers 155, 157, and a registration roller 159. A transport belt 161 is provided for transporting a recorded sheet to a fixing unit 163. The fixing unit 163 is provided for fixing an image on the copying sheet, which is transported by the transport belt 161, by heat fusing. A discharge roller 165 is included for transporting the fixed sheet to the pedestal 200, and a sensor 167 is provided for detecting a sheet in the case of duplex copying.

The surface of the photosensitive drum 131 is made of a seamless photosensitive member structured with a photoconductive member and an electrical conductor. The drum 131, which is supported for rotation about its axis, starts rotating in the direction indicated by the arrow upon actuation of the main motor 133 in response to depression of a copy start key. After completion of a predetermined rotation control and potential control process (preliminary process) of the drum 131, the original placed on the platen glass 101 is illuminated by the illumination lamp 103 integral with the first scanning mirror 105. The reflected light from the original passes through the first scanning mirror 105, the second scanning mirror 107, the third scanning mirror 109, the lens 111, and the fourth scanning mirror 113, and is focused on the drum 131.

The drum 131 is corona-discharged by the high voltage unit 135. Thereafter, the image (original image) illuminated by the illumination lamp is slit-exposed to thereby form an electrostatic latent image on the drum 131 by means of a known Carson method. Then, the electrostatic latent image on the photosensitive drum 131 is developed by the developing roller 140 of the developing unit 139, and visualized as a toner image. The toner image is transferred onto a copy sheet by the transfer charger 141 as will be explained later.

Meanwhile, the transfer sheet set in the upper cassette 151 or the lower cassette 153 or the transfer sheet set in the manual sheet feed inlet 171 is fed into the main body 100 by the feed rollers 155 or 157. The fed transfer sheet is then transported toward the photosensitive drum 131 at an accurate timing by the registration roller 159, whereby the tip of the latent image is made coincident with the leading edge of the transfer sheet. Thereafter, the toner image on the drum 131 is transferred onto the transfer sheet by passing the transfer sheet through the gap between the transfer charger 141 and the drum 131. After the transfer step has been completed, the transfer sheet is separated from the photosensitive drum 131 by the separation charger 143, and conducted into the fixing unit 163 by the transport belt 161.

In the fixing unit 163, the transferred image is fixed by the application of pressure and heat. The fixed sheet is then discharged out of the main body 100 by the discharge roller 165.

The drum 131 continues rotating after the image transfer so that the surface thereof is cleaned by the cleaning unit 145 structured with a cleaning roller and an elastic blade.

B. PEDESTAL 200

The pedestal 200 is provided for receiving and holding the sheet discharged from the main body 100. The pedestal 200 can be dismounted from the main body 100, and includes a deck 201 capable of accommodating 2000 transfer sheets, and an intermediate tray 203 for use in duplex copying. A lifter of the deck 201 rises up or goes down in accordance with the number of transfer sheets so as to always make the transfer sheet contact a feed roller 207.

The pedestal 200 also includes a feed support roller 208, and a discharge flapper 211 for switching between the passage for duplex or multi-recording and the discharge passage.

The pedestal 200 further includes transport passages 213, 215 for transport belt, and an intermediate tray weight 217 for pushing the transfer sheets. A transfer sheet passing through the discharge flapper 211 and the transport passages 213, 215 is turned over, and is accommodated within the intermediate tray 203 for duplex recording. A multi-flapper 219 for switching between the passages of the duplex recording and the passages of the multi-recording is mounted between the transport passages 213 and 215. The transfer sheet is guided toward a multi-recording passage 221 by moving the multi-flapper upwards.

A multi-discharge sensor 223 is provided for detecting the trailing edge of the transfer sheet in the case where the multi-flapper 219 is derived. A feed roller 225 is provided for feeding the transfer sheet from a passage 227 toward drum 131. A discharge roller 229 is provided for discharging the transfer sheet out of the pedestal 200.

In duplex recording or multi-recording, the flapper 211 is moved upwards to feed the copied transfer sheet to the passages 213, 215, and to accommodate it in the intermediate tray 203. In the case of duplex recording, the multi-flapper 219 is moved downwards. And, in the case of the multi-recording, the multi-flapper 219 is moved upwards.

The intermediate tray 203 can accommodate, e.g., 99 copied transfer sheets. The copied transfer sheets accommodated within the intermediate tray are held down by the intermediate tray weight 217. During the back side recording in duplex copying or during multi-recording, the transfer sheets within the intermediate tray 203 guided one by one from the bottom of the sheets stack via the passage 227 to the registration roller 159 with the aid of the feed roller 225 and the weight 217.

C. RDF (RECIRCULATING DOCUMENT FEEDER) 300

The recirculating document feeder (RDF) 300 is provided for feeding documents sequentially in a recycle fashion. In the RDF 300, a stacking tray 301 is provided for receiving a bundle S of originals sit thereon. If the original bundle S is a bundle of one-sided originals, the RDF 300 operates as follows.

The originals in the stacking tray 301 are separated one by one from the bottom of the original bundle S by means of a semicircular roller 304 and a separating roller 303, each of which is actuated by a separating motor (not shown). The original thus separated is transported to a exposure position on the platen glass 101 along paths I and II by means of a feed roller 305 and a flat-face belt 306, where the transport of the original is stopped and a copying operation is started.

After the copying operation, the original is fed into a path V over a path III by a feed large roller 307, and then returned to the top of the original bundle S by a discharge roller 308. A recycle lever 309 is provided for detecting one cycle of original feeding. The recycle lever 309 is placed on the top of the original bundle S at the start of feeding the originals, and the originals are fed one-by-one. When the trailing edge of the final original passes through the recycle lever 309, the recycle lever 309 falls by its own weight to detect the completion of one cycle of original feeding operation.

If the original bundle S is a bundle of double-sided originals, the RDF 300 operates as follows.

The original is conducted into the path III over the paths I and II as described above. Then, a rotatable switching flapper 310 is switched to conduct the leading edge of the original into a path IV. The original is then passed through the path II by the feed roller 305, transported to the platen glass 101 by the flat-face belt 306, and stopped. In other words, the original is reversed by the feed large roller 307 in accordance with the route formed by the paths III-IV-II.

The number of the originals can be counted, since the originals are fed one-by-one from the original bundle S over the paths I-II-III-IV-VI until the recycle lever 309 detects the completion of one cycle of original feeding operation. A paper detecting sensor 311 is provided for detecting the original.

D. SORTER 400

The sorter 400 has 25 tray bins 411 for loading or sorting recorded sheets.

Operation modes of the sorter 400 includes non-sort mode, sort mode, and collate mode, and the selected mode is displayed on the copying apparatus 100. When a copy start key 605 of an operation panel, which will be described later, is pressed, the sorter 400 operates as follows in accordance with a operation mode selected before the press of the copy start key 605.

In the non-sort mode, a bin unit shift motor 420 is not driven in response to sheet accomodation, thereby a bin shift operation is not performed. Accordingly, copied sheets are sequentially discharged from the main body 100 through the discharge roller 229, and accommodated within a single tray 411 through a non-sort discharge roller 407.

In the sort mode, the bin unit shift motor 420 is actuated in the case where the highest bin is in a position higher than a sort discharge roller 405. Each bin of the sorter 400 is shifted until the highest bin is in a position lower than the sort discharge roller 405. And, when the highest bin is in the lower position, the bin shift operation is stopped (such position is hereinafter referred to as "sort home position").

The copied sheets are sequentially discharged from the main body 100 through the discharge roller 229, and conducted to a transport roller 401 of the sorter 400. The copied sheets are then discharged into each bin 411 through a path 403 by the discharge roller 405. And, each bin is shifted upwards or downwards by the bin shift motor 420 each time a copied sheet is discharged into the associated bin.

In the collate mode, a bin shift motor 420 is driven to shift each bin to the sort home position as the SORT mode. The copied sheets are then sequentially discharged from the main body 100 through the discharge roller 229, and conducted to the transport roller 401 of the sorter 400. The copied sheets are discharged into each bin 411 through the path 403 by the discharge roller 405. And each bin is shifted upwards or downwards by the bin shift motor 420 each time the originals are fed one-by-one. A discharge detecting sensor 430 is provided for detecting the copied sheets.

E. KEY GROUP 600

Figure 3:
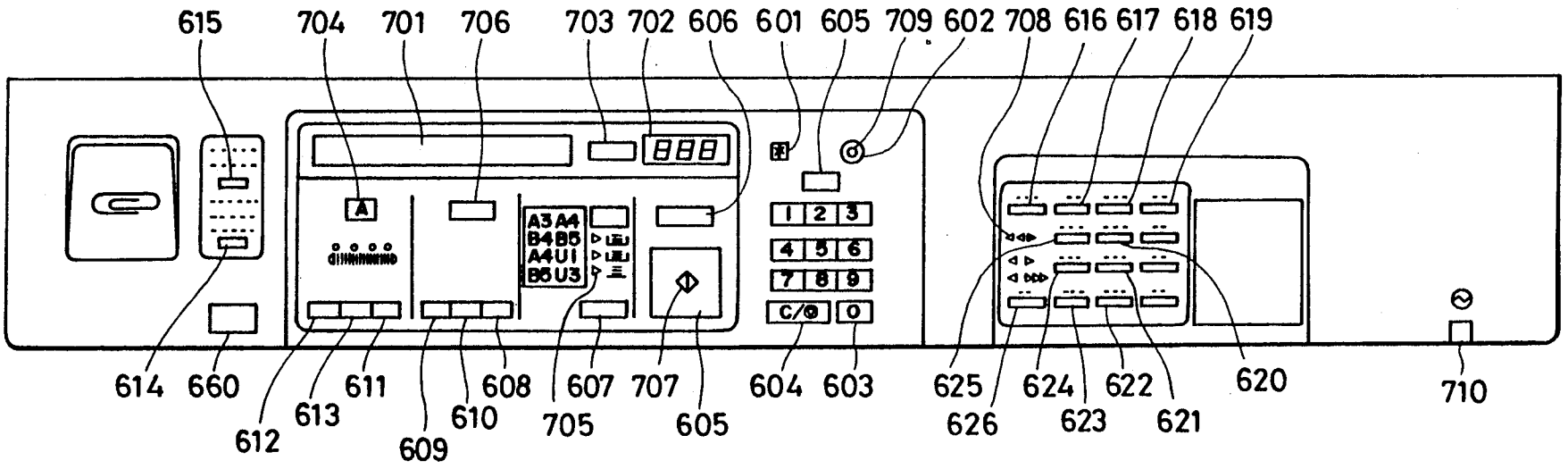
FIG. 3 is a top plan view showing an operation panel of an image recording apparatus.

FIG. 3 shows an example of the configuration of an operation panel provided on the aforementioned main body 100. The operation panel is structured with a key group 600 and a display group 700 as described hereinafter.

Referring to FIG. 3, an asterisk ("*") key 601 is provided for designating a set mode such as for setting a binding margin, an original frame erasure size and so forth by an operator. An "all reset" key 606 is provided for setting the copying apparatus to a standard mode. The all reset key 606 is pressed when the copying apparatus is set to the standard mode.

A pre-heat key 602 is provided for setting the mechanism of the main body 100 to a pre-heat state, or for releasing the pre-heat state. The pre-heat key 602 is also used for recovering from an automatic shut off state into the standard mode. Copy start key 605 is provided for starting a copying operation. Clear/stop key 604 functions as a clear key during a stand-by state and a stop key during a copying operation. When it functions as a clear key, the clear/stop key 604 is used for releasing the set number of copying sheets, and also used for releasing an asterisk mode. When it functions as a stop key, clear/stop key 604 is used for interrupting consecutive copying to stop the copying operation after the copying operation at the time of the key depression is completed.

A ten-key keypad 603 is provided for setting the number of copies, and for setting the asterisk mode.

Memory keys 619 are provided for registering modes an operator frequently uses. In this example, four modes M1 to M4 can be registered by the memory keys 619.

Copy density keys 611, 612 are provided for manually adjusting copy density. An AE (automatic exposure) key 613 is provided for automatically adjusting copy density in accordance with the density or original, and for switching the density adjustment from AE adjustment to manual adjustment.

A cassette selection key 607 is provided for selecting one of the upper cassette 151, lower cassette 153, and the deck 201. The cassette selection key 607 can be used as a key for selecting an APS (Automatic Paper Selection) mode while an original is placed on the RDF 300. Upon selection of the APS mode, the cassette having the same size sheet as the original can be automatically selected.

An equal magnification key 610 is provided for performing equal magnification (actual size) copying. An automatic variable magnification key 616 is provided for automatically reducing or magnifying the size of the image of an original depending on the designated transfer sheet image. Zoom keys 617, 618 are provided for designating a desired magnification factor between 64% to 142%. Regular magnification keys 608, 609 are provided for designating a regular size reduction or magnification.

A duplex copy key 626 is provided for producing a two-sided copy from a one-sided original, for producing a two-sided copy from a two-sided original, or for producing a one-sided copy from a two-sided original. A binding margin key 625 is provided for forming a binding margin having designated width on the left side of a transfer sheet. A photograph key 624 is provided for copying a photographic original. A multi-key 623 is provided for superimposing the images of two originals on the same surface of a transfer sheet.

An original frame erasure key 620 is provided for erasing the frame of a regular size original. The size of the original is set by the asterisk key 601 after the depressing of the original frame erasure key 620. A sheet frame erasure key 621 is provided for erasing the frame of an original in accordance with the size of a selected cassette. A page consecutive copy key 622 is provided for consecutively copying the right and left pages of an original onto different transfer sheets.

A discharge method (staple, sort, collate) selection key 614 is provided for selecting or releasing the staple mode or the sort mode in the case where a stapler is operatively coupled to bind recorded sheets with staples, or for selecting or releasing the sort mode or the collate mode in the case where the sorter is coupled. A sheet folding selection key 615 is provided for selecting or releasing a Z-fold operation, which folds an A3 or B4 size recorded sheet in Z-shape in cross section, or for selecting or releasing a half-fold operation, which folds an A3 or B4 size recorded sheet in halves.

A bin shift operation selection key 650 is also provided for selecting a first mode by which each bin is shifted to a primary position (the sort home position) before starting the accommodation of the recorded sheets, and for selecting a second mode by which the bin shift operation is not performed.

A discharge selection key 660 is provided for selecting discharge operation of a previously fed transfer paper.

F. DISPLAY GROUP 700

Referring to FIG. 3, an LCD (liquid-crystal device) type of message display 701 is provided for displaying copying information. The message display 701 can display a 40-character message, each character being structured with 5×7 dots, and a copying magnification set by the regular magnification keys 608, 609, the equal magnification key 610, and the zoom keys 617, 618. The message display 701 is a semi-transparent liquid-crystal display, and two backlight colors are employed. Normally, green backlight lights, but in an abnormal or a copy-disable state, orange backlight lights.

An equal magnification display 706 is provided for lighting in the case where equal magnification is selected. A color developing unit display 703 is provided for lighting in the case where a sepia developing unit is set. A copy number display 702 is provided for displaying the number of copies or a self-diagnosis code. A selected-cassette display 705 is provided for displaying which of the upper cassette 151, the lower cassette 153, and the deck 201 is selected. An AE display 704 is provided for lighting in the case where an AE mode (automatic copy density adjustment mode) is selected by the AE key 613.

A pre-heat display 709 is provided for lighting during the pre-heat state, and for blinking during the automatic shut off state. A ready/wait display 707 structured with a green-emitting LED and an orange-emitting LED is provided for lighting the green-emitting LED in a ready (copy-enable) state, and for lighting the orange-emitting LED in a wait (copy-disable) state.

A duplex copy display 708 is provided for lighting in the case where the production of a two-sided copy from a two-sided original or the production of a two-sided copy from a one-sided original is selected. If the RDF 300 is used in the standard mode, the copying apparatus sets the number of copies at "one", and sets the AE mode, the ASP mode, equal magnification, and the production of a one-sided copy from a one-sided original automatically.

If the RDF 300 is not used in the standard mode, the copying apparatus sets the number of copies for "one", and sets manual density adjustment, equal magnification, and the production of a one-sided copy from a one-sided original.

The difference between use and non-use of the RDF 300 depends on whether an original is placed on the RDF 300 or not.

A power source lamp 710 is provided for lighting in the case where a power switch is turned on.

G. CONTROL DEVICE 800

Figure 4:
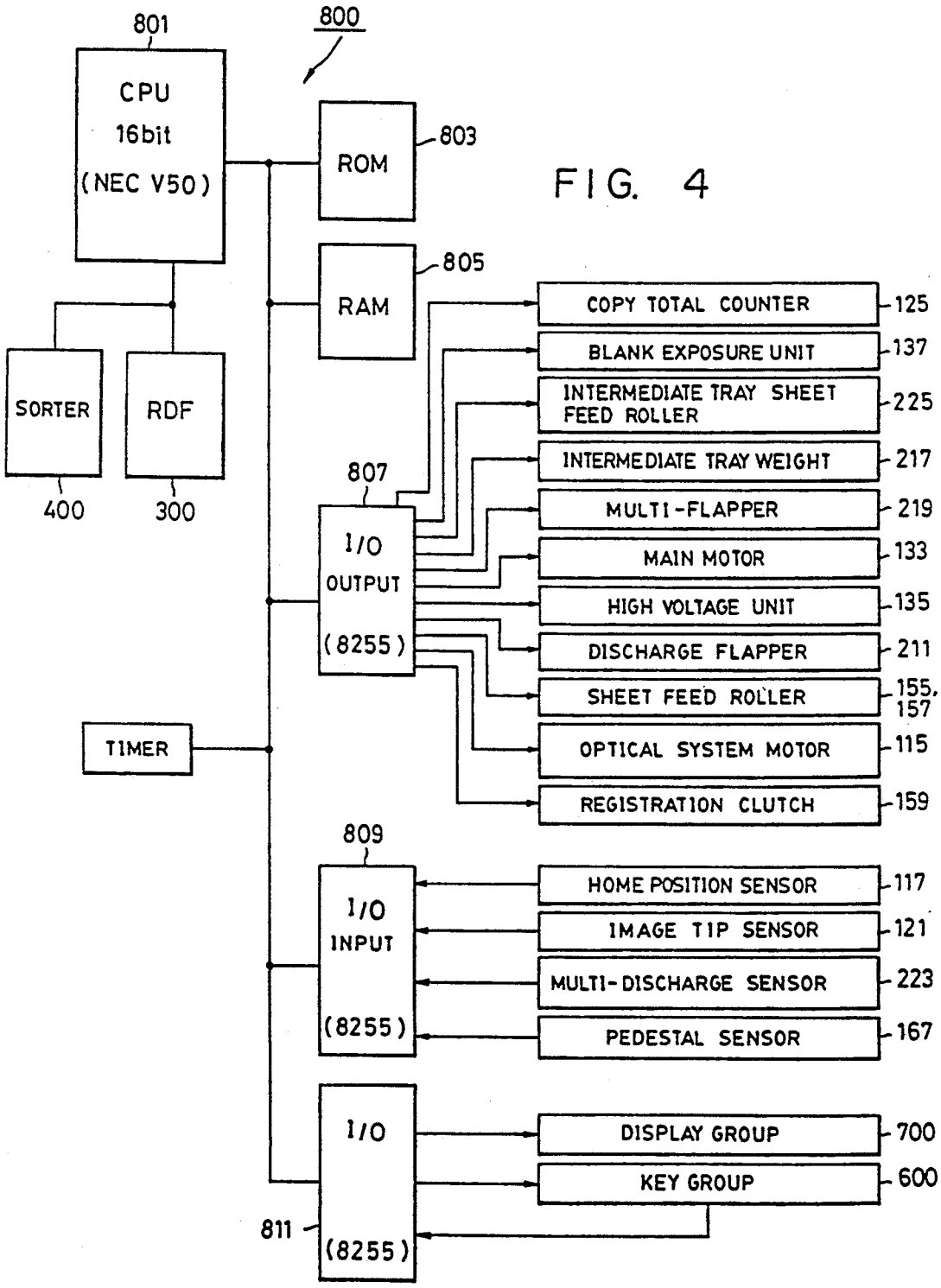
FIG. 4 is a block diagram showing a circuit of a control unit of an image recording apparatus according to this invention.

FIG. 4 is an example showing a circuit arrangement of a control device 800 of the copying apparatus main body 100. In the drawing, a central processing unit (CPU) 801 performs operation control for executing image formation and sheet post-processing. A read only memory (ROM) 803 is provided for storing a control procedure (control program), which will be described hereinafter. The CPU 801 controls each element connected thereto via a bus in accordance with the control procedure stored in the ROM 803.

A random access memory (RAM) 805 is provided as a main storage device for storing input data, or for using as a working memory area.

An interface (I/O) 807 is provided for outputting control signals from the CPU 801 to each load, for example, the main motor 133, a copy total counter 125, the blank exposure unit 137, the high voltage unit 135, the sheet feed rollers 155, 157, the optical system motor 115, the registration clutch 159, the intermediate tray sheet feed roller 225, the multi-flapper 219, the discharge flapper 211, and the intermediate tray weight 217. An interface (I/O) 809 is provided for sending signals inputted from the image tip sensor 121, the home position sensor 117, the pedestal sensor 167, the multi-discharge sensor 223, and so forth to the CPU 801.

An interface (I/O) 811 is also provided for controlling input/output operations between the key group 600 and the display group 700. A timer 812 is provided for counting a predetermined time.

The display group 700 corresponds to the displays shown in FIG. 3, and utilizes LEDS or LCDs. The key group 600 corresponds to the keys shown in the same drawing, and the CPR 801 can discriminate which key is pressed by utilizing a known key matrix.

Figure 5:
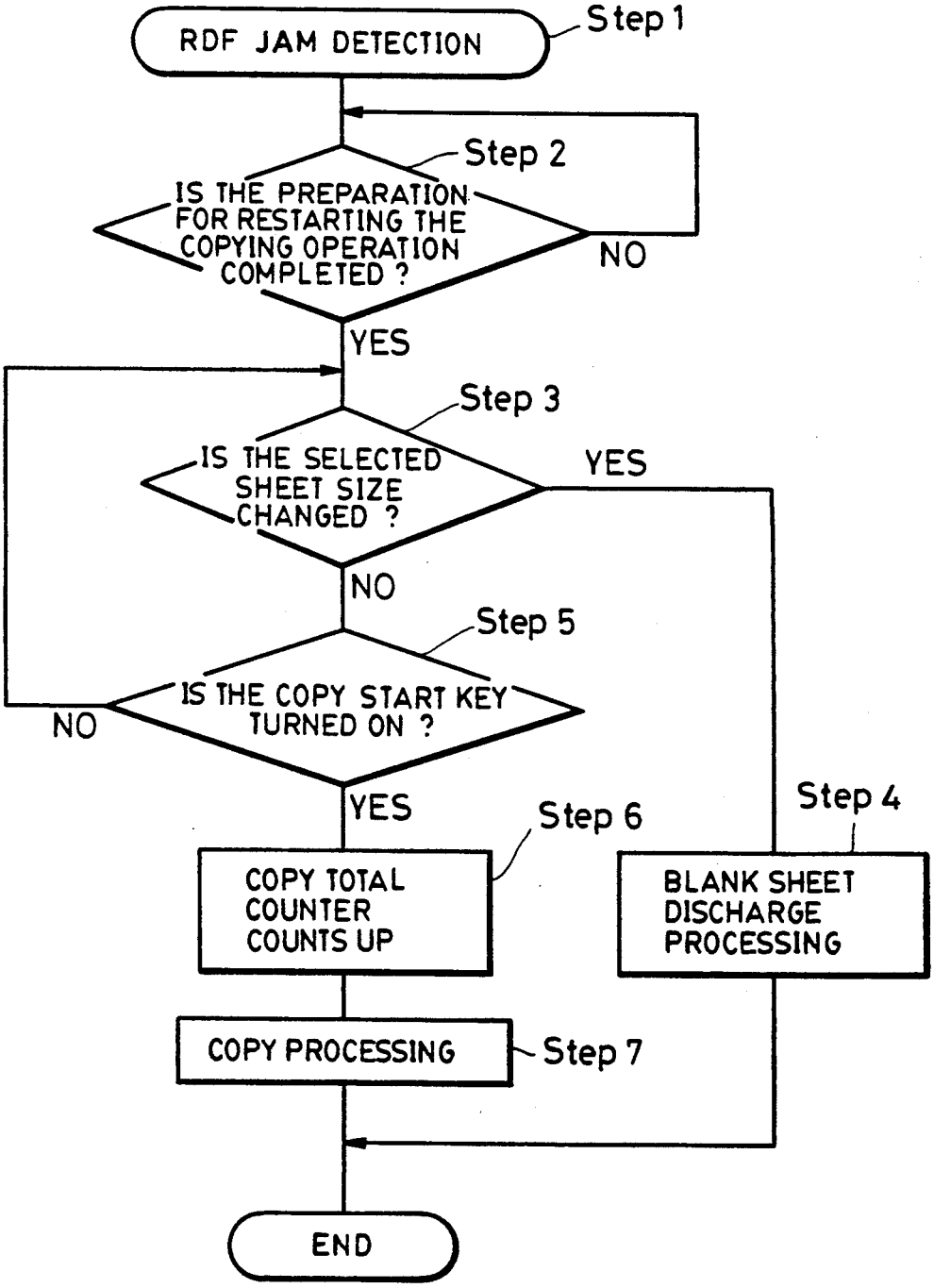
FIG. 5 is a flow chart showing a control procedure according to a first embodiment of the present invention.
Figure 6A:
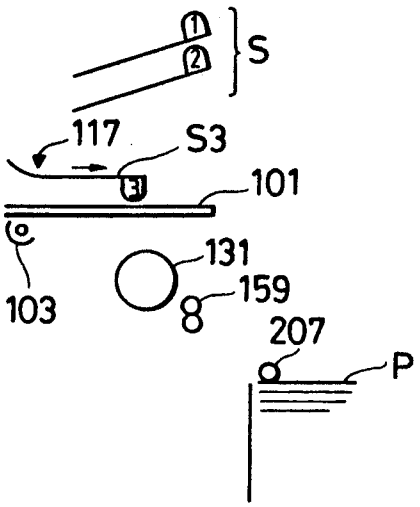
FIG. 6A through FIG. 6C are diagrams for explaining a known sheet feed sequence operation.
Figure 6B:
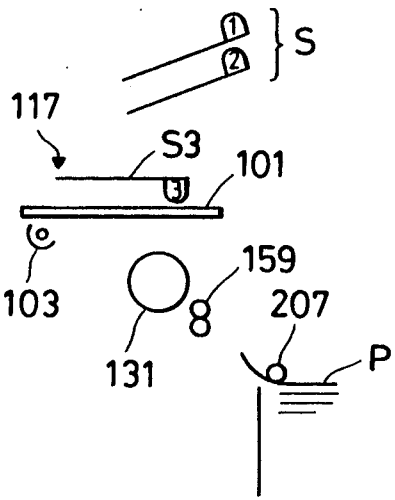
Figure 6C:
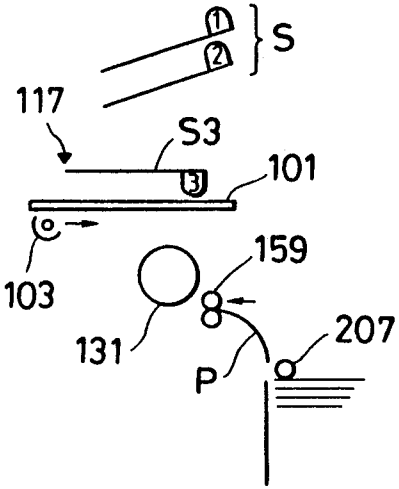
Figure 7A:
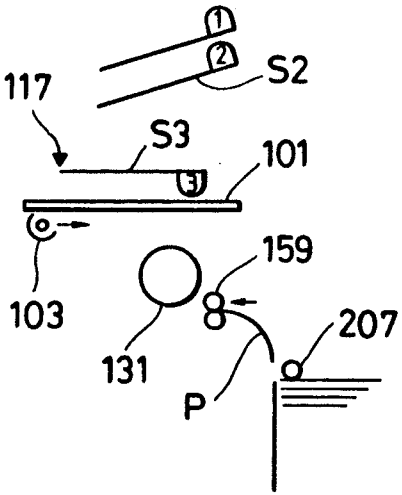
FIG. 7A through FIG. 7C are diagrams for explaining a known previously-fed sheet sequence operation.
Figure 7B:
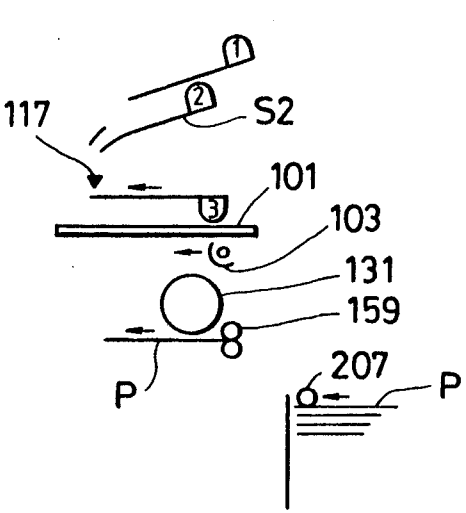
Figure 7C:
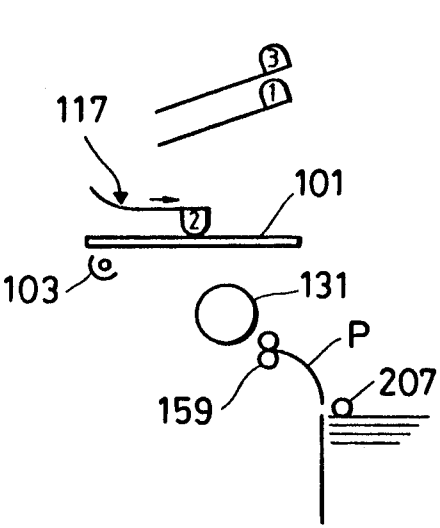

FIG. 5 is a flow chart showing a control procedure according to a first embodiment of the present invention.

In step 1, during an original feeding by the RDF 300, if sensor 311 detects that the original has not fed properly, then a "stationary jamming" is indicated. When a stationary jamming is indicated, a previously fed blank copying sheet is stopped and held by the registration roller 159. A copying sheets onto which an image has successfully been transferred, is discharged normally, and the main motor 133 is stopped after performing a predetermined post-rotation.

In step 2, the CPU 801 determines whether the jamming by the paper detecting sensor 311 has been corrected or not. That is, the CPU 801 determines whether a preparation for restarting the copying operation is completed or not. When, in step 2, the preparation is completed, the flow advances to step 3.

In step 3, the CPU 801 discriminates whether the selected sheet size is changed or not by pressing the cassette selection key 607 or whether another sheet size different from the size of the previously fed blank sheet by the APS mode is selected or not.

When the CPU 801 determines that the selected sheet size is changed, the flow advances to step 4. In step 4, the previously fed blank copying sheet is discharged without transferring an image (such processing is hereinafter referred to as "blank sheet discharge processing").

When, in step 3, the selected sheet size is consistent with the size of the previously fed blank sheet, the flow advances to step 5 to await depression of the copy start key 605.

In step 6, the copy total counter 125 counts up. In step 7, an image is transferred onto the previously fed blank sheet as described above.

According to a conventional copying apparatus, when a jamming is detected during original exchange operation by the RDF, a previously fed blank sheet is discharged out of the apparatus unconditionally without being copied, and the copy total counter counts up. However, according to this embodiment, an image is transferred onto a previously fed blank sheet in the case where the selected sheet size is consistent with the size of the blank sheet upon restarting the copying operation. And the blank sheet is discharged out of the apparatus in the case where the selected sheet size is not consistent with the size of the blank sheet.

In the latter case, an unnecessary charge to an operator can be avoided by preventing the counting up of the copy total counter 125.

Figure 8:
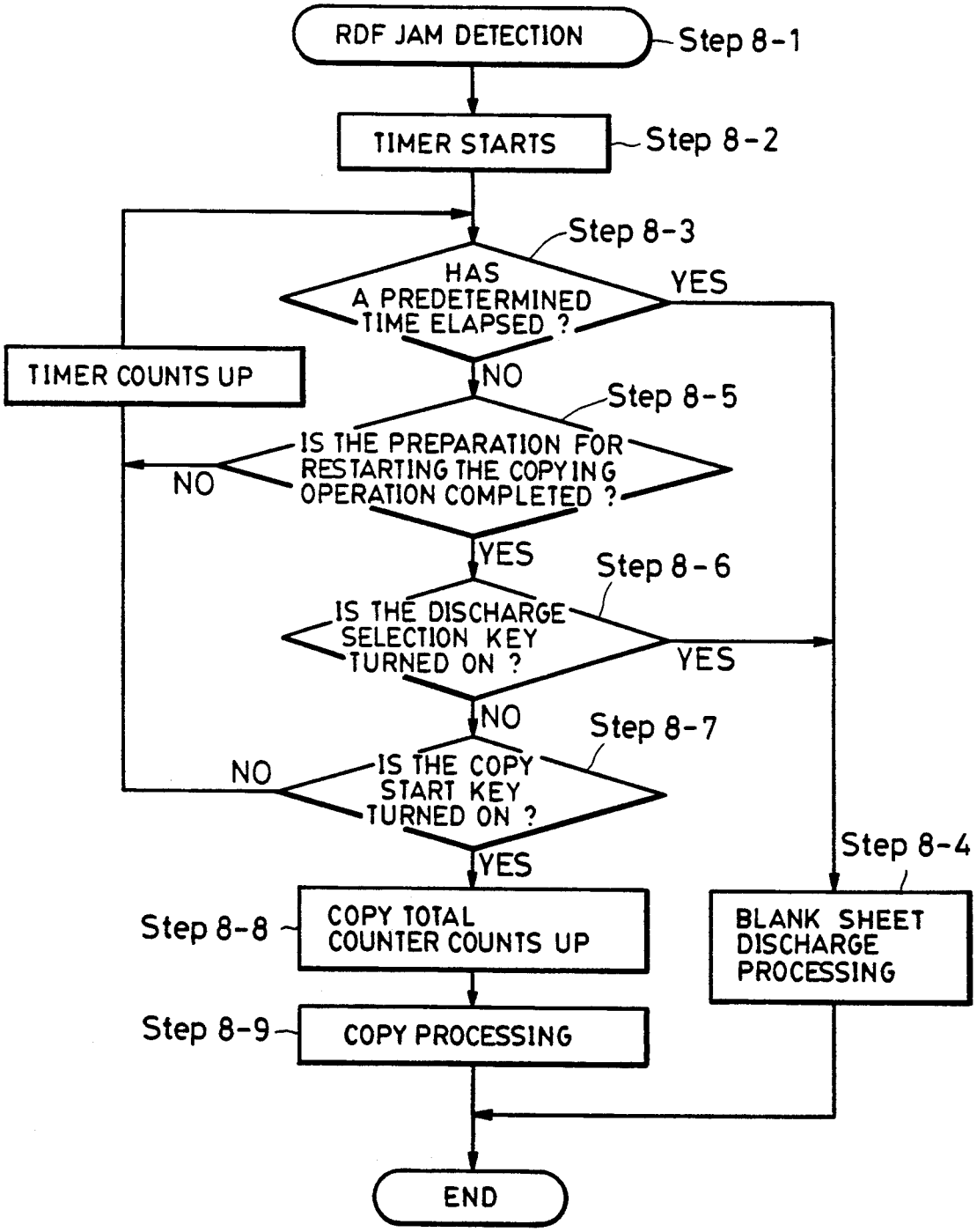
FIG. 8 is a flow chart showing a control procedure according to a second embodiment of the present invention.

FIG. 8 is a flow chart showing a procedure of a control operation according to a second embodiment of the present invention.

In step 8-1, during an original feeding by the RDF 300, when a stationary jamming is detected by the paper detecting sensor 311, control progesses to step 8-2 where the timer 812 starts, and a previously fed blank copying sheet is stopped and held by the registration roller 159.

A copying sheet onto which an image has successfully been transferred is discharged normally, and the main motor 133 is stopped after performing a predetermined post-rotation. Step 8-3 checks whether a predetermined time has elapsed or not. In the case where the jamming is not corrected even if the predetermined time has elapsed, the flow advances to step 8-4. In step 8-4, the previously fed blank sheet is discharged without transferring an image.

On the other hand, when, in step 8-3, the CPU 801 determines that the predetermined time has not elapsed, control progresses to step 8-5 where the CPU 801 determines whether a preparation for restarting the copying operation is completed or not. When the preparation is not completed, the flow returns to step 8-3 to wait a counting up of the timer.

When, in step 8-5, the CPU 801 determines that the preparation is completed, the flow advances to step 8-6. Step 8-6 checks whether the discharge selection key 660 is turned on or not.

When the CPU 801 determines that the discharge selection key 660 is turned on, the flow advances to step 8-4, and the previously fed blank sheet is discharged without transferring an image. When, in step 8-6, the CPU 801 determines that the discharge selection key 660 is not turned on, the flow advances to step 8-7.

In step 8-7, it is checked whether the copy start key 605 is turned on or not. When the CPU 801 determines that the copy start key 605 is turned on, the copy total counter 125 counts up in step 8-8. In step 8-9, an image is transferred onto the previously fed blank sheet. If the discharge selection key 660 or the copy start key 605 are not turned on within the predetermined time, the CPU 801 executes the blank sheet discharge processing.

According to the second embodiment, the timer 812 starts when a jamming is detected. If the discharge selection key 660 is turned on within a predetermined time, or unless the copy start key 605 is turned on even if the discharge selection key 660 is not turned on, a previously fed blank sheet is discharged as a plain sheet without transferring an image. When the blank sheet is discharged, the copy total counter does not count up. And, an image is transferred onto the previously fed blank sheet only in the case where the copy start key 605 is turned on within the predetermined time.

Figure 9C:
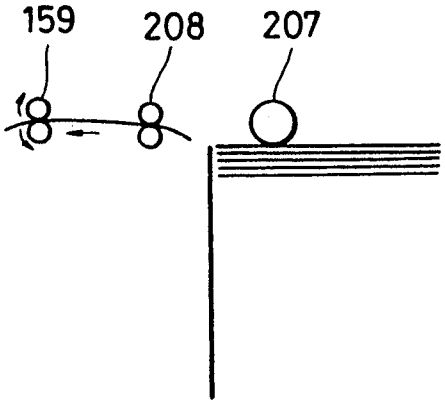
FIG. 9A through FIG. 9C are diagrams for explaining loop correction processing.
Figure 9B:
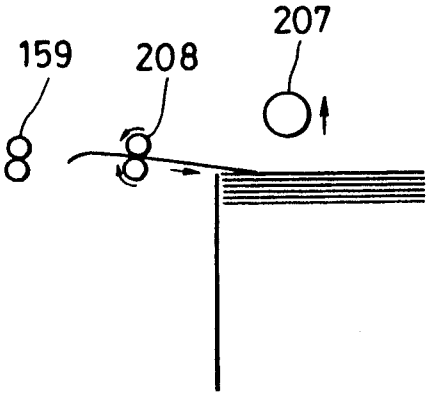
Figure 9A:
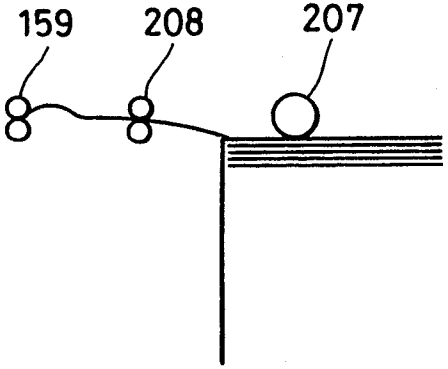

FIG. 9A illustrates the reason for setting the predetermined time. If a previously fed blank sheet is left in the form of a loop for a long time while feeding the blank sheet into the registration roller 159, the blank sheet becomes curled, which adversely affects the ability of the blank sheet to receive an image.

FIG. 9A through FIG. 9C illustrate loop correction processing of a previously fed blank sheet. In FIG. 9A, the previously fed blank sheet is stopped in the form of a loop for feeding the blank sheet into the registration roller 159, as described above.

In the case where a jamming in the RDF 300 is detected, the feed roller 207 is pulled up, and the feed support roller 208 is reversed to correct the loop as illustrated in FIG. 9B (such processing is hereinafter referred to as "feed reversing processing"). This prevents a normal copying operation from being disturbed by curling of the blank sheet if the loop formed in the blank sheet is not corrected.

As illustrated in FIG. 9C, it is also possible to correct the loop by feeding only a portion of the blank sheet, which corresponds to the formed loop, in advance upon rotating the registration roller 159 in the forward direction from a state formed the loop as illustrated in FIG. 9A.

Figure 10:
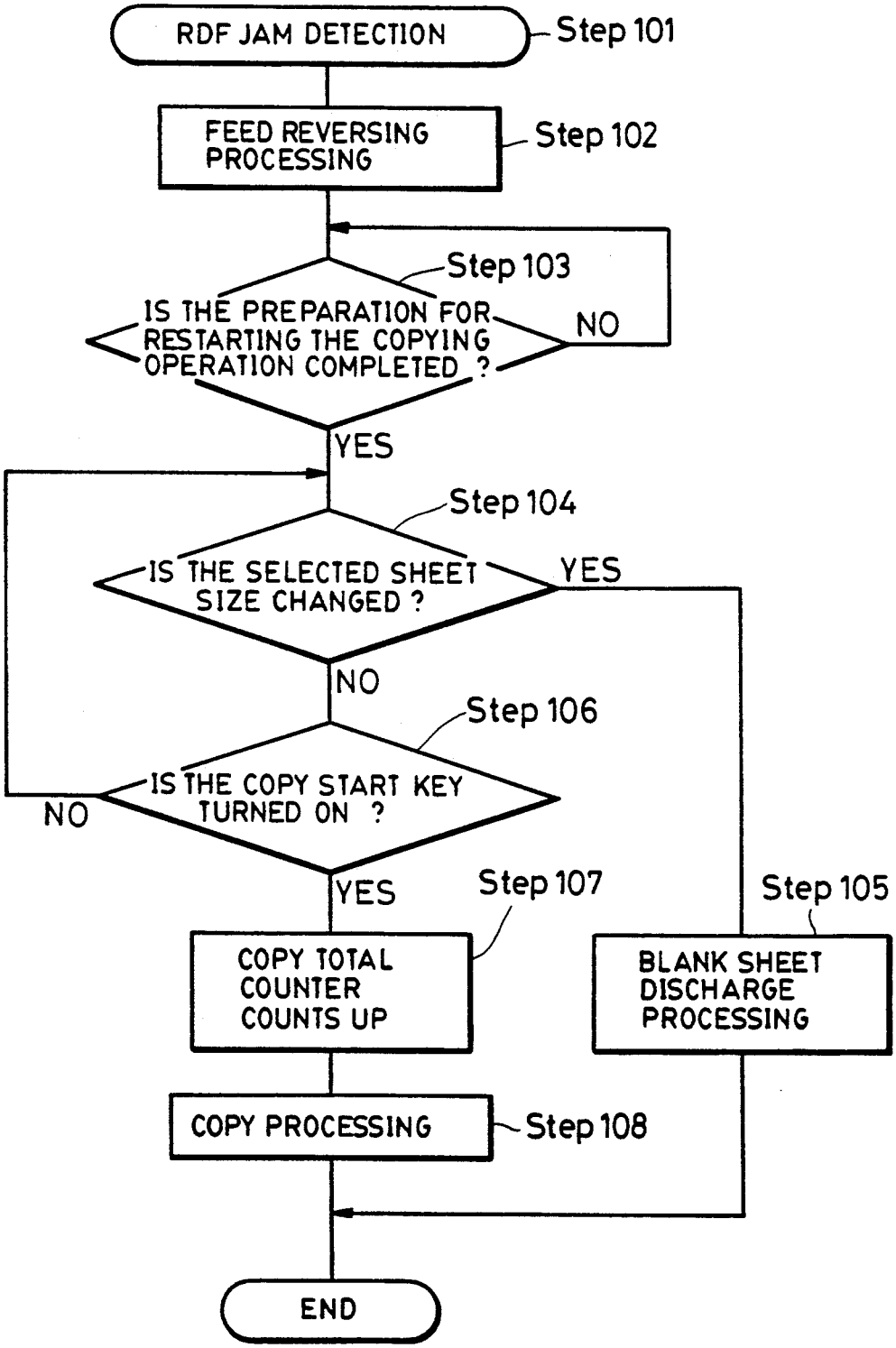
FIG. 10 is a flow chart showing a control procedure according to a third embodiment of the present invention.

FIG. 10 is a flow chart showing a control procedure including the above mentioned loop correction processing.

In step 101, during an original feeding by the RDF 300, when a stationary jamming is detecting by the paper detecting sensor 311, the above mentioned feed reversing processing is performed in step 102.

In step 103, a sheet, on which an image has successfully been transferred is discharged normally, and the main motor 133 is stopped after performing a predetermined post-rotation. When the CPU 801 determines by the paper detecting sensor 311 that the jamming has been corrected, preparations for restarting the copying operation are undertaken.

When the CPU 801 determines that the preparation has been completed, the flow advances to step 104.

In step 104, the CPU 801 discriminates whether the cassette selection key 607 has been depressed to change the selected sheet size, or whether another sheet size different from the size of a previously fed blank sheet by the APS mode has been selected or not.

When the CPU 801 determines that the selected sheet size is changed, the flow advances to step 105. In step 105, the previously fed blank sheet is discharged without transferring an image. When, in step 104, the CPU 801 determines that the selected sheet size is not changed, that is, the selected sheet size is consistent with the size of the previously fed blank sheet, the flow advances to step 106 to wait for the copy start key 605 to be pressed.

In step 107, the copy total counter 125 counts up.

In step 108, an image is transferred onto the previously fed blank sheet.

According to this embodiment, when a jamming is detected, the last blank sheet fed from a cassette is reversed back toward the cassette, and is held so that it can be reused after the jamming is corrected.

The last blank sheet fed from cassette is discharged out of the apparatus in the case where the selected sheet size is not consistent with the size of the last blank sheet upon restarting the copying operation. In this case, the copy total counter 125 doesn't count up.

On the other hand, an image is transferred onto the last blank, sheet, which can be reused after the jamming is corrected, in the case where the selected sheet size is consistent with the size of the last blank sheet.

As mentioned above, according to the present invention, unnecessary consumption of a sheet can be prevented. Further, according to the present invention, an unnecessary charge to an operator can be prevented.

Although particular embodiments of the preset invention are herein disclosed for purposes of explanation, various modifications thereof, after study of this specification, will be apparent to those skilled in the art to which the invention pertains.

The specific structural details of the devices represented by blocks in the schematic diagrams of FIGS. 1 and FIGS. 4 are per se well known or could be readily constructed by the person of ordinary skill in this field. Therefore, the exact structure of the blocks in the schematics is not described in further detail in order to describe the present invention more clearly, and since such details are not critical to the best mode of carrying out the present invention.

While the present invention has been described with respect to what is presently considered to be the preferred embodiments, it is to be understood that the invention is not limited to the disclosed embodiments. To the contrary, the present invention is intended to cover various modifications and equivalent arrangements included within the spirit and scope of the appended claims.

What is claimed is:

1. An image recording apparatus comprising:
original transporting means for transporting originals to an exposure position;
jam detection means for detecting a jamming of the original in transporting to the exposure position;
sheet feeding means for feeding a recording sheet;
recording means for recording an image from the original on the recording sheet fed by said sheet feeding means;
sheet holding means for stopping and holding a sheet fed by said sheet feeding means in a predetermined position when said jam detection means detects a jamming of the original; and
control means for causing said sheet feeding means to feed a recording sheet held by said sheet holding means in order to record on said sheet when image recording resumes after releasing jamming.

2. An image recording apparatus according to claim 1, wherein said sheet feeding means starts feeding a recording sheet before an original arrives at said exposure position.

3. An image recording apparatus according to claim 1, further comprising: sheet size selection means for selecting an arbitrary sheet size; sheet discharge means for discharging the sheet held by said sheet holding means when another sheet size different from the size of the held sheet is selected by said sheet size selection means.

4. An image recording apparatus according to claim 1, further comprising sheet discharge instruction means for forcibly discharging the sheet held by said sheet holding means.

5. An image recording apparatus according to claim 4, wherein said sheet discharge instruction means includes a manual instruction key for instructing the discharge of the sheet held by said sheet holding means.

6. An image recording apparatus according to claim 1, further comprising sheet discharge instruction means for discharging the sheet held by said sheet holding means, wherein said sheet discharge instruction means includes a timer for counting a predetermined time after the detection of the jamming by said jam detection means to discharge the sheet forcibly.

7. An image recording apparatus according to claim 1, further comprising counting means for counting discharged sheets, wherein said counting means stops the counting operation when the sheet held by said sheet holding means is discharged without recording an image.

8. An image recording apparatus comprising:

sheet feeding means for feeding a recording sheet, said sheet feeding means comprising loop forming means for stopping the recording sheet fed by said sheet feeding means in a predetermined position temporarily and for forming a loop in the sheet so that the sheet is fed accurately;

malfunction detecting means for detecting a malfunction in said image recording apparatus;

loop correction means for reducing quantity of the loop in response to a detection signal from said malfunction detecting means.

9. An image recording apparatus according to claim 8, further comprising original feeding means for feeding originals to be copied, wherein said malfunction detecting means includes a jam detector for detecting a jamming of an original fed by said original feeding means.

10. An image recording apparatus according to claim 8, further comprising:

sheet size selection means for selecting an arbitrary sheet size;

sheet discharge means for discharging the sheet corrected by said loop correction means when another sheet size different from the size of the corrected sheet is selected by said sheet size selection means.

11. An image recording apparatus according to claim 8, further comprising counting means for counting discharged sheets, wherein said counting means stops the counting operation when the sheet in which the quantity of the loop is reduced by said loop correction means is discharged without recording an image.

12. A copying apparatus comprising:

original feeding device for feeding originals to an image reading position sequentially;

copying sheet feeding means for feeding a copying sheet corresponding to an original fed by said original feeding device to a copying positon;

copying means for copying an image on the copying sheet fed to the copying position;

original jamming detectgion means for detecting an original jammed in said original feeding device;

copying operation prohibition means for prohibiting a copying operation to the copying sheet fed by said copying sheet feeding means in accordance with a jam detection signal from said original jamming detection means;

copying sheet holding means for holding the copying sheet fed by said copying sheet feeding means in accordance with the jam detection signal; and determination means for determining whether to feed a sheet held by said sheet holding means after releasing jamming of the original to perform copying on said sheet, or to discharge said sheet without copying.

13. A copying apparatus according to claim 12 further comprising discharge means for discharging the copying sheet held by said copying sheet holding means without copying an image in accordance with a determination result by the determination means.

14. A copying apparatus according to claim 12, further comprising counter means for counting the total number of sheets copied by said copying apparatus, wherein said counter means counts when said determination means determines to copy on said sheet and prohibits counting when said determination means determines to discharge said sheet without copying.

* * * * *